US009528258B1

(12) United States Patent
McBride et al.

(10) Patent No.: US 9,528,258 B1
(45) Date of Patent: Dec. 27, 2016

(54) MANHOLE RING SUPPORT FOR UNIFIED CONCRETE POURS AROUND GREASE INTERCEPTOR

(71) Applicant: Thermaco, Inc., Asheboro, NC (US)

(72) Inventors: Travis McBride, Asheboro, NC (US); William C Batten, Asheboro, NC (US)

(73) Assignee: Thermaco, Inc., Asheboro, NC (US)

( * ) Notice: Subject to any disclaimer, the term of this patent is extended or adjusted under 35 U.S.C. 154(b) by 0 days.

(21) Appl. No.: 14/829,182

(22) Filed: Aug. 18, 2015

Related U.S. Application Data

(60) Provisional application No. 62/039,986, filed on Aug. 21, 2014.

(51) Int. Cl.

| | |
|---|---|
| ***E03F 5/16*** | (2006.01) |
| ***E04H 7/18*** | (2006.01) |
| ***E04H 7/26*** | (2006.01) |
| ***E02D 27/38*** | (2006.01) |

(52) U.S. Cl.
CPC ..... *E03F 5/16* (2013.01); *E02D 27/38* (2013.01); *E04H 7/18* (2013.01); *E04H 7/26* (2013.01)

(58) Field of Classification Search
CPC ..... E03F 5/16; E02D 27/38; E04H 7/18
USPC ..... 52/20, 19
See application file for complete search history.

(56) References Cited

U.S. PATENT DOCUMENTS

| | | | | |
|---|---|---|---|---|
| 3,858,998 | A * | 1/1975 | Larsson | E02D 29/1409 404/26 |
| 4,065,022 | A * | 12/1977 | Cainaud | B65D 88/128 220/1.5 |
| 4,722,800 | A * | 2/1988 | Aymong | B01D 17/0208 210/170.01 |
| 5,037,239 | A * | 8/1991 | Olsen | B09B 1/00 405/129.5 |
| D320,055 | S * | 9/1991 | Parker | D23/202 |
| 5,344,253 | A * | 9/1994 | Sacchetti | E02D 29/1409 404/25 |
| 6,161,985 | A * | 12/2000 | Hinkle | E02D 29/1409 249/2 |
| 6,371,687 | B1 * | 4/2002 | Heintz | E02D 29/1409 404/26 |
| 6,514,009 | B2 * | 2/2003 | Northcott | B65D 88/78 220/23.91 |
| 6,527,476 | B1 * | 3/2003 | Pettesch | B65D 90/105 404/26 |
| 6,698,973 | B2 | 3/2004 | Suatac | 404/26 |
| 6,752,565 | B2 * | 6/2004 | Schrage | E02D 29/1427 404/25 |
| 6,811,350 | B2 * | 11/2004 | Nadasde | E02D 29/1445 404/26 |
| 6,953,302 | B1 * | 10/2005 | Kochling | E02D 29/121 404/26 |

(Continued)

*Primary Examiner* — Brian Glessner
*Assistant Examiner* — Paola Agudelo
(74) *Attorney, Agent, or Firm* — MacCord Mason PLLC

(57) ABSTRACT

A kit of materials to make a support for one or more manhole rings during a concrete pour around a prefabricated grease interceptor includes a base, a plurality of vertical supports, and a peripheral grid to surround a top of the prefabricated grease interceptor at a position to support a manhole seating ring. The vertical supports are long enough that they extend from the base to the peripheral grid for most grease interceptor installations or can be cut to size to position the peripheral grid.

6 Claims, 5 Drawing Sheets

(56) References Cited

U.S. PATENT DOCUMENTS

| | | | | |
|---|---|---|---|---|
| 7,021,471 | B2 * | 4/2006 | Abrams | B01D 17/0208 210/519 |
| 7,367,459 | B2 | 5/2008 | Batten et al. | 210/521 |
| 7,641,805 | B2 | 1/2010 | Batten et al. | 210/801 |
| 7,883,290 | B1 * | 2/2011 | Ross | E02D 29/1427 210/163 |
| 9,127,430 | B2 * | 9/2015 | Mitchell | E02D 29/1409 |
| 2012/0195686 | A1 | 8/2012 | Hardgrave | 405/52 |
| 2013/0312338 | A1 * | 11/2013 | Gaspar | E02D 29/12 52/19 |
| 2016/0145848 | A1 * | 5/2016 | Skinner | E02D 29/125 52/20 |

* cited by examiner

MANHOLE RING SUPPORT FOR UNIFIED CONCRETE POURS AROUND GREASE INTERCEPTOR

This application claims the benefit of U.S. provisional application No. 62/039,986 filed Aug. 21, 2014 which is incorporated by reference in its entirety.

BACKGROUND OF THE INVENTION

The present invention relates to an improvement in the means for installing prefabricated underground grease traps or grease interceptors. It is particularly suitable for use with the Trapzilla grease interceptor sold by Thermaco, Inc. of Asheboro, N.C. Trapzilla interceptors are described in U.S. Pat. No. 7,367,459 and related technology in U.S. Pat. No. 7,641,805 for solid separation. The disclosures of these two U.S. Patents are incorporated herein by reference in their entireties.

One of the ways to install such grease interceptors includes underground installation where effluent piping from a building is received in an inlet pipe of the grease interceptor. An outlet pipe to a sewage line is connected to an outlet pipe of the grease interceptor. These occur underground, with the grease interceptor buried underground. FIG. 1 shows such an underground installation with inlet 150 and outlet 152.

Such installations often occur in restaurant parking lots, which will receive vehicular traffic overhead on pavement. Access to the grease interceptor for grease removal and periodic maintenance is made through a manhole mounted in the pavement, giving access to a space above the grease interceptor, which is itself closed by a lid. Lid 20 for the grease interceptor fits on the top of an extension collar 21 as seen in FIG. 1. FIG. 1 also shows the manhole cover 18 positioned above, to be received on manhole cover ring 16.

At installation, the grease interceptor is mounted underground and concrete is poured around it to reinforce and stabilize its position. Previously, two concrete pours have been needed, one to fill up the space around the grease interceptor, stopping short of the ground level. Once the first concrete pour has been allowed to set, placement of the manhole ring 16 has followed, and a further concrete pour was needed to fill in concrete around the manhole cover 16. Sequential pours required considerable added effort, expense and trouble, since two visits to the construction site are required by the concrete delivery truck.

SUMMARY OF THE INVENTION

The present invention fulfills one or more needs in the art by providing a kit of materials to make a support for a manhole ring during a concrete pour around a prefabricated grease interceptor. The kit includes a base, a plurality of vertical supports, and a peripheral grid to surround a top of the prefabricated grease interceptor at a position to support a manhole ring. The base may include a bottom areal component so that the base can be located under the prefabricated grease interceptor. The vertical supports are long enough that they extend from the base to the peripheral grid for most grease interceptor installations or can be cut to size to position the peripheral grid. Brackets may be added to affix the vertical supports to exterior walls of the prefabricated grease interceptor.

The base and peripheral grid typically have the same shape, such as square, depending on the shape of the prefabricated grease interceptor. Preferably, the base and grid have sockets to receive the vertical supports, and the sockets may be located at corners of the squares. The peripheries of the base and peripheral grid may be made of angle irons. An annular barrier ring may be included in the kit for insertion between an inside of the manhole ring and an outside of a neck of the grease interceptor. The bottom areal component may be expanded metal. The kit may further include bolts that are inserted through the manhole ring and into holes on the peripheral grid and nuts that vertically adjust and fasten the manhole ring onto the peripheral grid.

The invention can also be considered as a method of installing a prefabricated grease interceptor having a neck. The method includes excavating a pit deep enough to allow the grease interceptor to be entirely underground, with access from ground level through a manhole ring. A manhole ring support is affixed to the grease interceptor, including adjusting lengths of vertical supports so that they position a top of the manhole ring at ground level, The grease interceptor with manhole ring support is lowered into the pit. Piping is connecting to the grease interceptor. The manhole ring is positioned on the manhole ring support with an annular barrier ring between an inside of the manhole ring and an outside of the neck of the grease interceptor. Then wet concrete is poured around the grease interceptor within the pit up to a level where concrete flows under the manhole ring until it is barred by the annular barrier ring, and the concrete is allowed to cure. The wet concrete is typically poured outside of the manhole ring to ground level.

Affixing a manhole ring support to the grease interceptor desirably includes assembling a plurality of vertical supports to a base and to a peripheral grid adjacent the neck of the grease interceptor. The vertical supports may be affixed to exterior walls of the prefabricated grease interceptor with brackets. Assembling a plurality of vertical supports to a base and to a peripheral grid may include inserting the vertical supports into sockets on the base and peripheral grid. Positioning the manhole ring may include positioning a ring that meets AASHTO H20 rating.

In other embodiments, the kit of materials may be used to make a support for a plurality of manhole rings during a concrete pour around one or more prefabricated grease interceptors. The kit in these embodiments include a base of perimeter angle irons, a socket at each corner of the base, a plurality of vertical supports, a peripheral grid with a plurality of flat beams, and an annular barrier ring. The annular barrier ring is inserted between an inside of the manhole ring and an outside of a neck of the grease interceptor. The peripheral grid includes sockets to receive tops of the vertical supports, and the plurality of flat beams are arranged on the peripheral grid to create square-shaped cavities that surround the top of the prefabricated grease interceptors at a position to support each manhole ring. Brackets may be included to affix the vertical supports to exterior walls of the prefabricated grease interceptors. The disclosed kits may also be employed to house one or more solids separators individually or in combination with one or more grease interceptors. Other units that are installed underground with a concrete pour are also contemplated by the current disclosure.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
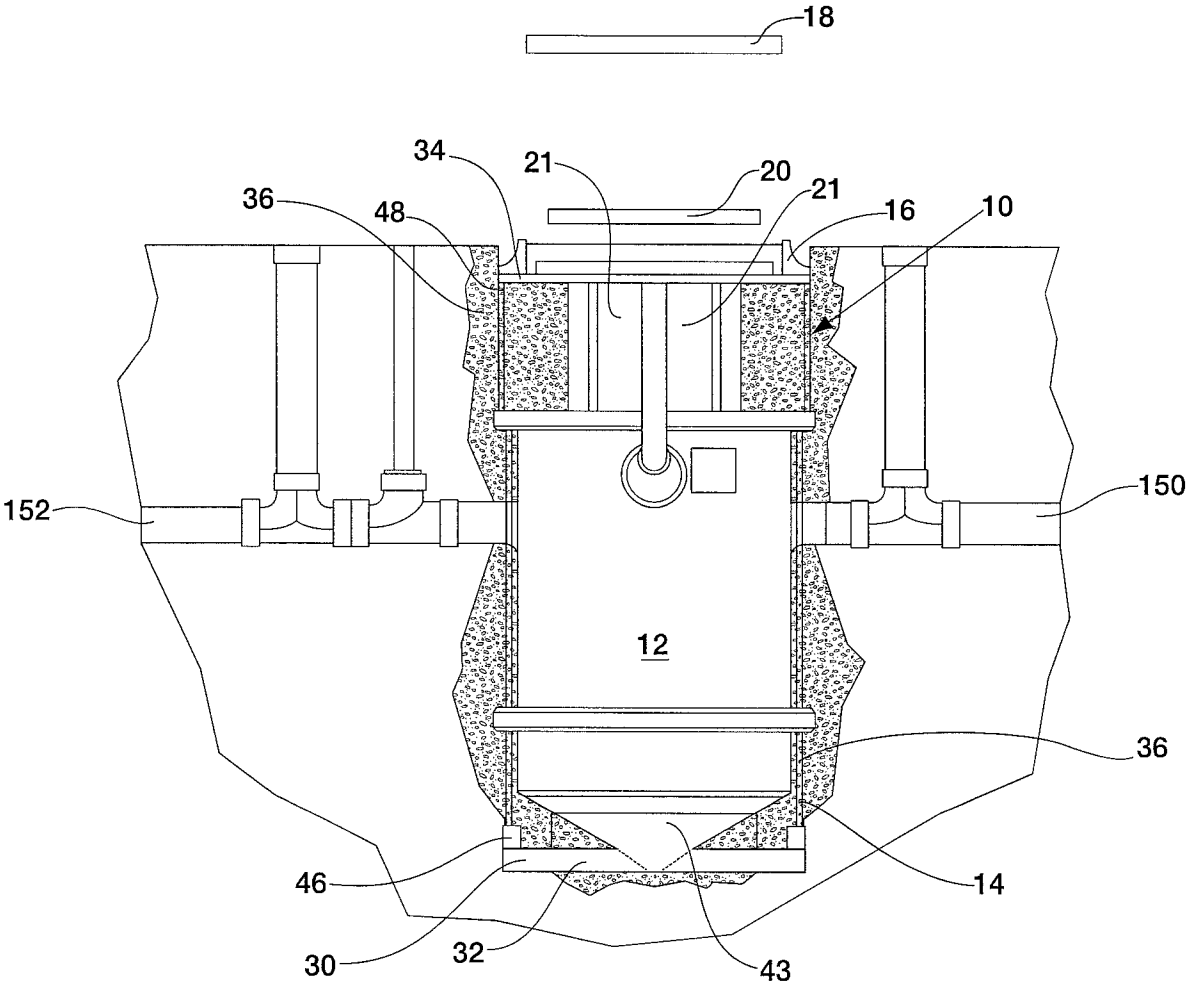
FIG. 1 is a schematic view of the manhole ring support for unified concrete pours around a grease interceptor lowered into a pit.
Figure 3:
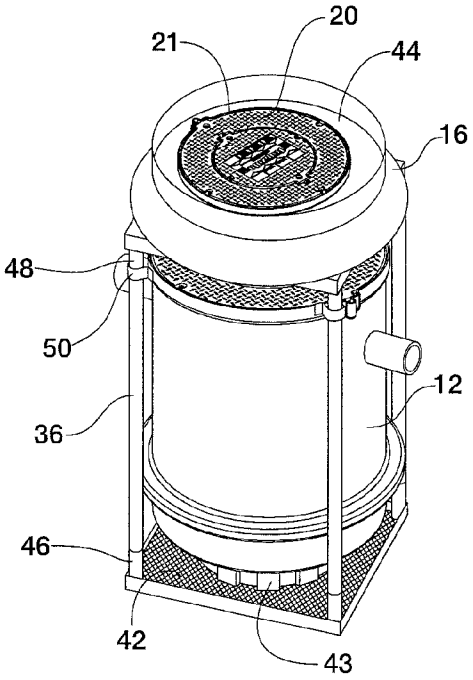
FIG. 3 is a perspective view of the assembled manhole ring support around the grease interceptor.
Figure 2A:
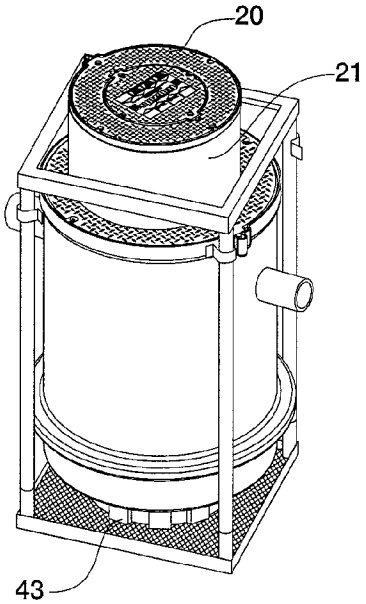
FIG. 2*a* is a perspective view of the assembled manhole ring support surrounding a grease interceptor.
Figure 2:
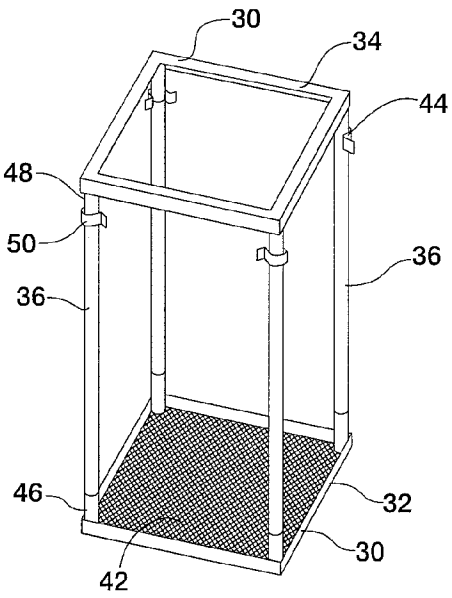
FIG. 2 is a perspective view of the assembled manhole ring support.

As seen in FIG. 1, the grease interceptor 12 is positioned underground, but housed in a cage 10 formed from a kit. The cage 10 provides a support for the manhole ring 16, so that the ring 16 can be positioned before the initial concrete pour, allowing the entire amount of concrete needed to be poured at one time. The manhole ring 16 may be AASHTO H2O rated. The cage 10 is made up of a base unit 32, a top unit or grid 34 and connecting support tubes or rods 36. As seen in FIGS. 2, 2*a*, and 3, the base unit 32 and top unit 34 are rectangular, made of angle irons 30 joined together at 90° angles to make a square or other rectangle. Other shapes can be used for the units besides rectangular. Socket members 46 and 48 are positioned and preferably welded inside the resulting corners for receipt of the supporting tubes 36. The socket members can be short lengths of tubing with inside diameters selected to receive an inserted tube 36. Thus, with the base and top units being square, there will be four of the connecting tubes 36. However, other shapes and other numbers of connecting tubes can be used. Preferably, the base 32 is spanned by an areal support member such as expanded metal 42 which is preferably welded or otherwise held in place to the base unit 32. It can also easily be held in place by gravity. For interceptors with tapered bottoms like the Trapzilla® interceptor made by Thermaco, Inc. of Asheboro, N.C., a support stand 43 may be used on the expanded metal. The support stand 43 is conventional for Trapzilla products and has a conical recess into which the conical bottom of the interceptor (shown in phantom in FIG. 1) fits. As seen in FIGS. 2*a* and 3, the grease interceptor has an upper extension collar 21.

Also shown in FIG. 2 are four U-shaped clamps or brackets 50 which can be used to clamp the supporting tubes 36 to a flange of the grease interceptor, as seen in FIG. 3. FIG. 3 also shows the manhole ring 16 resting on the top grid 34. An annular concrete barrier 44 is shown in position in FIG. 3 between the outside of the extension collar 21 of the grease interceptor and the inside of the manhole ring 16. The barrier 44 allows the concrete to be poured outside the manhole ring 16 and to flow up underneath the barrier 44, but not go higher where it might interfere with the easy access to the cover 20 of the grease interceptor.

Figure 4:
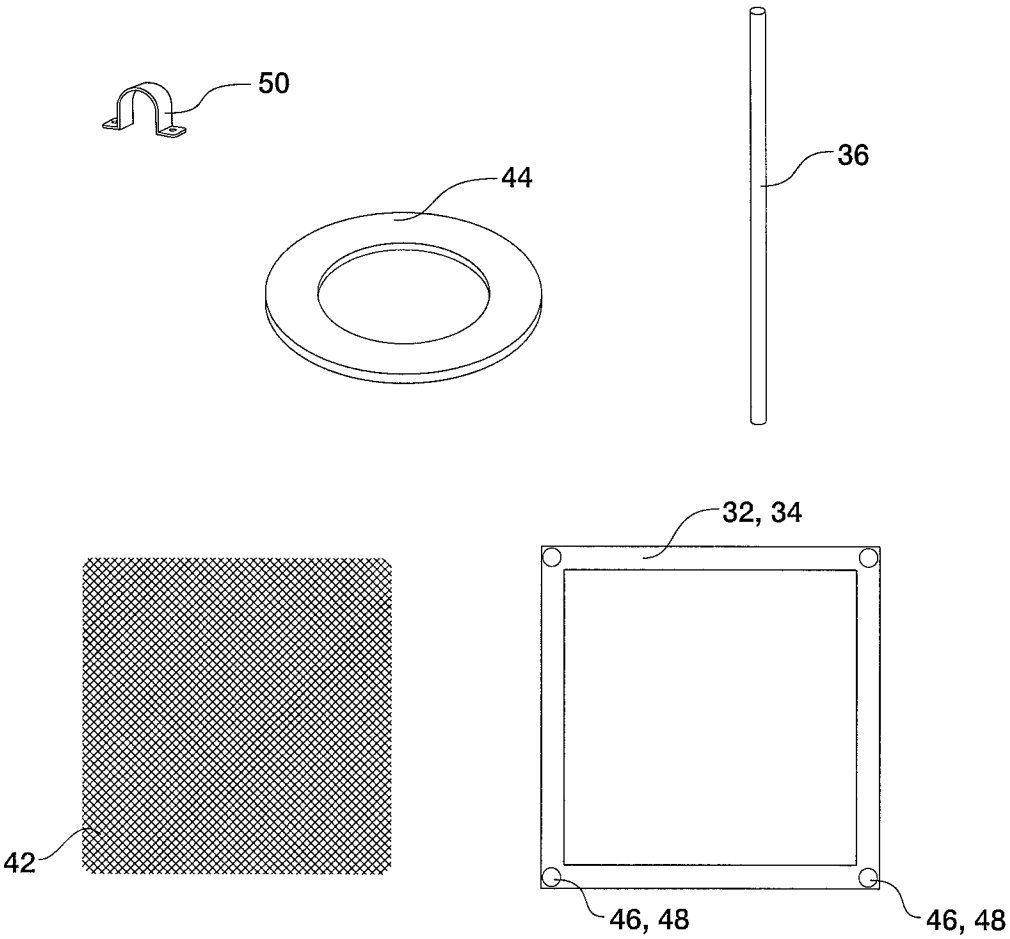
FIG. 4 is a perspective view of the kit of materials to make the manhole ring support.

FIG. 4 shows the materials which make up the kit to be used to make the cage 10. Two items made up of the angle based frames are included (only one is shown in FIG. 4), one to serve as the base 32 and the other to serve as the top grid 34. Each is provided at its corner with a socket 46 or 48. Essentially, the two frames 32 and 34, as shown, are identical, except that the base frame 32 can have the expanded metal grating 42 preinstalled, such as by welding. Alternatively, the expanded metal can be a separate component and installed into the base frame at assembly time. Only one of the support tubes 36 is shown in FIG. 4, but the number of them to be provided, corresponds with the number of angles in the base frames 32, 34. Similarly, a corresponding number of the U-shaped clamps 50 are included to clamp respective ones of the support members 36 to the exterior of the grease interceptor. Finally, FIG. 4 shows the annular concrete barrier or cement flow stop foam board 44. This is conveniently provided as an expanded foam, such as Styrofoam, or alternate material such as a plastic or plywood.

Figure 5:
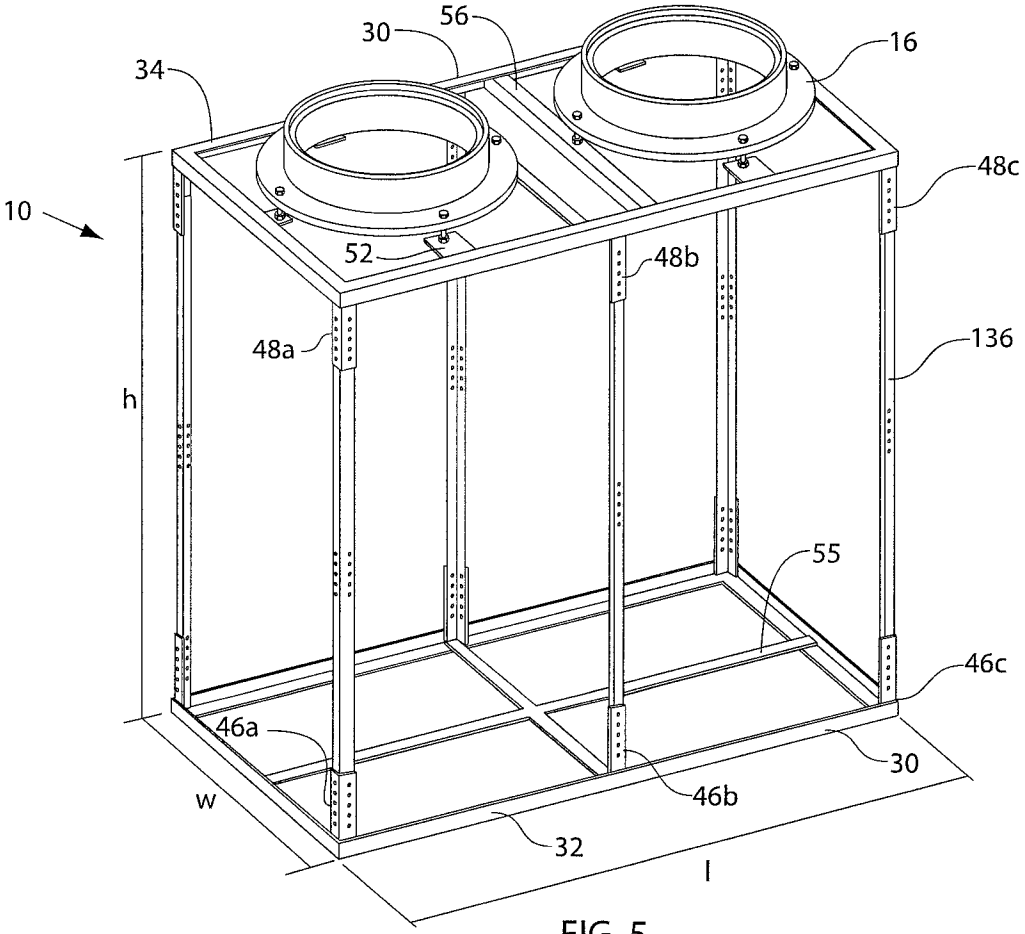
FIG. 5 is a perspective view of another embodiment of the assembled manhole ring support.
Figure 6:
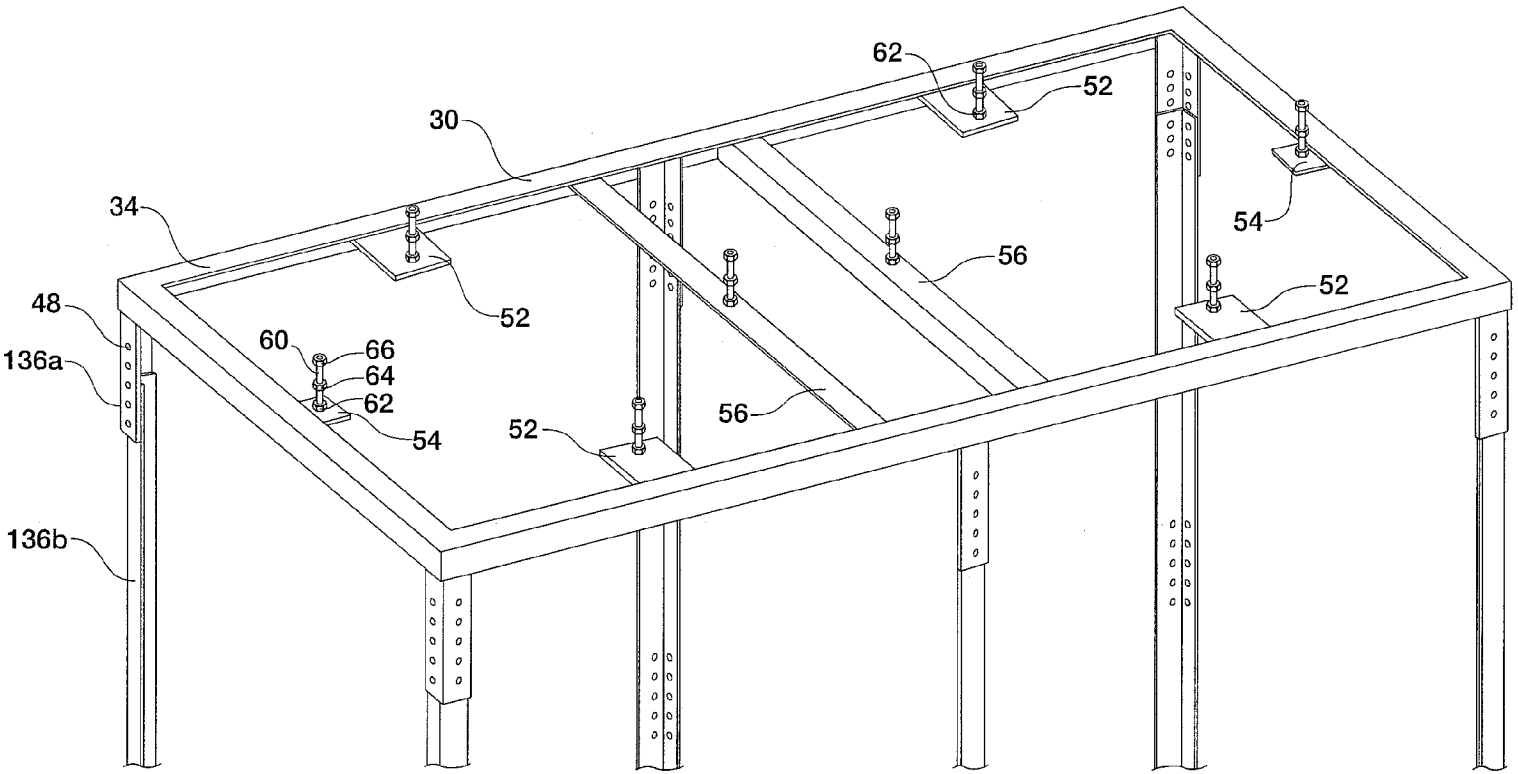
FIG. 6 is a close-up view of the embodiment shown in FIG. 5.

In other embodiments, cage 10 may be configured to house multiple grease interceptors or a grease interceptor and solids separator. FIG. 5 illustrates one embodiment where two such units may be housed within cage 10. Base frames 32, 34 are shown to be rectangular, made of angle irons 30 joined together at 90° angles. Base unit 32 includes supporting members 46*a,b,c* and top unit 34 includes supporting members 48*a,b,c*. Supporting members 46*a,c* and 48*a,c* are placed on the corners at the ends of cage 10. Supporting members 46*b* and 48*b* are located between 46*a,c* and 48*a,c*, to provide structural support for cage 10. The supports 136 in the embodiments shown in FIGS. 5 and 6 are also configured of angle irons in several segments 136*a*, 136*b*, as seen in FIG. 5. The ends of the segments have a series of regularly spaced holes. The ends of adjacent segments overlap so the holes can align. The choice of which holes to align can be made at the job site to result in a desired overall length, with the segments joined by a nut and bolt arrangement. Additional supporting members may be added along angle iron 30 depending upon the overall length of cage 10. Base unit 32 may further include flat beams 55 to provide a flooring for cage 10. Expanded metal grating 42 may also be added to the embodiment shown in FIG. 5.

As seen in FIGS. 5 and 6, flat beams 56 may be added to top unit 34 to provide structural support for manhole ring 16. Flat beams 56 may be welded along angle irons spanning the width of cage 10 and spaced to accommodate installation of manhole ring 16. Flat beams 56 include holes 62 adapted to receive bolt 60. Manhole ring 16 may be installed by fastening it to angle iron 30 and flat beam 56. Alternatively, as shown by the embodiment depicted in FIGS. 5 and 6, angle iron 30 may include ears 52 and 54 with holes 62 that receive bolt 60 for fastening manhole ring 16 onto cage 10. Ears 52 and 54 are sized so that they overlap with manhole ring 16. FIG. 6 depicts ears 52 and 54 differing in size, but in other embodiments, they are identical in size. In yet other embodiments, ears 52 or 54 may be omitted.

In one embodiment, manhole ring 16 is installed onto cage 10 by aligning its peripheral holes with holes 62 of top unit 34. Bolts 60 are inserted through manhole ring 16 and into holes 62, and are fastened by nut 66. The embodiment shown in FIGS. 5 and 6 further include nut 64 that enables manhole ring 16 to be vertically adjustable. The height of manhole ring 16 is adjusted by adjusting the height of nut 64 in relation to bolt 60. Manhole ring 16 sits on top of nut 64 and is fastened in place by nut 66.

In operation, the kit of materials is delivered to the job site along with the grease interceptor to be installed. A pit is dug to receive the grease interceptor, so that the inlet and outlet of the interceptor are at appropriate heights for the needed plumbing installations. In accordance with Trapzilla technology, the access port in a neck can be raised by adding selected number of extension collars 21 upward from the top of the grease interceptor 12 involved to just below grade level. The resulting height of the extended interceptor dictates the length of the support tubes 36 to be used. They are cut to size or procured to size to span the distance from the bottom of the pit to where the manhole ring is to be installed, taking into account the respective thicknesses of the frames 32 and 34. The frame 32 with its expanded metal grate 42 is installed in the bottom of the pit, the support tubes are mounted in their respective sockets, and the top grid 34 is mounted onto the support tubes by fitting the support tubes into sockets 48 of the top base frame. Then, the grease interceptor is installed into the resulting cage and may be retained in place by providing screws into holes in the U-shaped clamp 50 into the outer ring of the grease interceptor. Alternatively, the interceptor is installed before the addition of top grid 32 to complete the cage. The cement flow stop board 44 is positioned in place around the extension collar 21. The manhole ring 16 can then be lowered onto the support frame 34. The height of manhole ring 16 may be adjusted by manipulating nut 64 along bolt 60, and fastening manhole ring 16 with nut 66. If multiple manhole rings are to be installed, then flat beams 56 may be included to help support each manhole ring.

Once the manhole ring is installed, then concrete can be poured around the periphery of the cage, filling the space around the grease interceptor in the pit until it backs up around the extension collar and up under the cement flow stop board 44, completing the concrete pour all in one pour. The cover 20 can be placed on the top of the extension ring, and the manhole cover 18 can be placed on the manhole ring 16.

Alternatively, the cage can be assembled to the grease interceptor before it is lowered into the pit. Then the concrete can be poured, as just described.

The brackets or clamps 50 can be omitted from various embodiments, as seen in FIGS. 5 and 6.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A method of installing a prefabricated grease interceptor having a neck, the method comprising the acts of:

excavating a pit deep enough to allow the grease interceptor to be entirely underground, with access from above ground to the grease interceptor through a manhole ring, affixing a manhole ring support to the grease interceptor, including adjusting lengths of a plurality of vertical supports under the manhole ring so that they position a top of the manhole ring at ground level, lowering the grease interceptor with manhole ring support into the pit, connecting piping to the grease interceptor, positioning the manhole ring on the manhole ring support with an annular barrier ring between an inside of the manhole ring and an outside of the neck of the grease interceptor, pouring wet concrete around the grease interceptor within the pit up to a level where concrete flows under the manhole ring until concrete is barred by the annular barrier ring, and allowing the concrete to cure.

2. A method as claimed in claim 1 wherein pouring wet concrete includes pouring concrete outside of the manhole ring to ground level.

3. A method as claimed in claim 1 wherein affixing a manhole ring support to the grease interceptor includes assembling the plurality of vertical supports to a base and to a peripheral grid adjacent the neck of the grease interceptor and affixing the plurality of vertical supports to exterior walls of the prefabricated grease interceptor with brackets.

4. A method as claimed in claim 3 wherein assembling a plurality of vertical supports to a base and peripheral grid includes inserting the vertical supports into sockets on the base and peripheral grid.

5. A method as claimed in claim 3 wherein affixing the manhole ring support further includes inserting bolts through the manhole ring support into holes on the peripheral grid and adjusting the height of the manhole ring support by affixing a nut located below the manhole ring support to the desired position.

6. A method as claimed in claim 1 wherein the manhole ring meets AASHTO H20 rating.

* * * * *